US005377746A

United States Patent [19]

Reid et al.

[11] Patent Number: 5,377,746

[45] Date of Patent: Jan. 3, 1995

[54] TEXTURIZED FIN

[75] Inventors: Don R. Reid, Jenks; Larry J. Sims, Tulsa, both of Okla.

[73] Assignee: Fintube Limited Partnership, Tulsa, Okla.

[21] Appl. No.: 51,788

[22] Filed: Apr. 26, 1993

[51] Int. Cl.[6] ..... F28F 1/36

[52] U.S. Cl. ..... 165/184; 165/133

[58] Field of Search ..... 165/133, 183, 184

[56] References Cited

U.S. PATENT DOCUMENTS

| | | | |
|---|---|---|---|
| 817,938 | 4/1906 | Stolp et al. | 165/184 X |
| 927,702 | 7/1909 | Zent | 165/184 |
| 2,667,337 | 1/1954 | Chapman | 165/184 |
| 2,731,245 | 1/1956 | McChesney | 165/184 X |
| 4,648,441 | 3/1987 | van de Sluys et al. | 165/111 |

FOREIGN PATENT DOCUMENTS

| | | | |
|---|---|---|---|
| 906282 | 9/1962 | United Kingdom | 165/184 |
| 1677481 | 9/1991 | U.S.S.R. | 165/184 |

*Primary Examiner*—Allen J. Flanigan
*Attorney, Agent, or Firm*—William S. Dorman

[57] ABSTRACT

A finned tube comprising a tube and a texturized solid fin attached thereto, the fin having a proximal edge and an opposite distal edge, the proximal edge being attached helically to the tube so the fin extends outwardly from the tube, the fin having two opposite faces extending from the proximal edge to the distal edge, the two faces of the fin being texturized by regular, small female impressions. In one embodiment the fin is texturized at a location between a fin material supply station and the point of attachment of the fin to the tube. In another embodiment, the fin is texturized at the fin attachment station.

2 Claims, 4 Drawing Sheets

TEXTURIZED FIN

BACKGROUND OF THE INVENTION

1. Field of the Invention

Metallic tubular heat exchangers must pass heat through the metallic wall and the two exchanging media film resistances. In this indirect exchange, the two media often offer unequal resistance to heat flow. Boilers, superheaters, economizers and air-cooled exchangers have greater shell side resistance to heat flow than the tube side. So, designs commonly employ various designs of extended surface on the outside of tubes. Materials of construction and methods of attachment depend on the intended service conditions. But very high unit area gains are manufacturable in transverse, helically wrapped fins. Area ratios of fin surface to bare tube surface are commonly 8:1 to 16:1.

Generally, the higher the extended area ratio the more compact and cost effective the heat exchanger. There is a manufacturing vs. design interplay between fin parameters to determine good fin combinations. But more fins per unit length and taller fins yield ever increasing extended area ratios. Limits are imposed by the fin efficiency as well as the manufacturing process.

Many fin surfaces are utilized in single phase, gas heat transfer. Investigation into the structure of fin surfaces teach ways to increase heat transfer rate, increase unit surface area, and promote surface self cleaning- Segmented or discontinuous fins interrupt gas boundary layer build-up and have greatly increased heat transfer rates over solid, smooth fins. Again compared to solid fins, the manufacturing process becomes much easier for segmented fins so that taller fins are producible, yielding higher unit surface areas.

Fin surfaces used in fluid phase change applications benefit from more complex geometry. Here the fin structure benefits by having multiple nucleation sites. The sites encourage more continuous wetting and very small pressure gradients.

2. The Prior Art

There have been many improvements in fin structures, requiring several modifications in the manufacturing process. Although these improvements are interrelated, there is a hierarchy. The segmented fin is an improvement in heat transfer rate and may be as an independent fintube or in a composite HVAC (heating, ventilating, air-conditioning) exchanger.

Patent searches were conducted and the following listed patents are deemed to be broadly pertinent:

| Patent No. | Inventor | Issue Date |
|---|---|---|
| British 906,282 | Carr | 09/19/62 |
| 3,183,970 | Worley | 05/18/65 |
| 4,040,479 | Campbell, et al. | 08/09/77 |
| Japanese 56-130598 | Jukogyo, et al. | 03/17/80 |
| 4,211,276 | Itoh | 07/08/80 |
| 4,227,572 | Harlan | 10/14/80 |
| 4,480,684 | Onishi | 11/06/84 |
| 4,538,677 | Bodas, et al. | 09/03/85 |

U.S. Pat. No. 4,480,684 (Onishi) taught up to 20% heat transfer rate improvements by using discontinuous and convoluted fin surfaces in an HVAC exchanger. Likewise, U.S. Pat. No. 3,183,970 (Worley) taught long radial depression in fin sides, while U.S. Pat. No. 4,227,572 (Harlan) taught fin edge tears, both increasing rates in an independent fintube. U.S. Pat. No. 4,040,479 also taught rate improvement by edge tears for nucleate boiling sites.

Prior art teaching increased unit area include British Patent No. 906,282 (Carr) wherein fin surface grooves and serrations brought the areas up by a factor of two (×2), and U.S. Pat. No. 4,211,276 (Itoh) wherein film surface sheet metal was doped to affect area gain depending on dope contact angle in a HVAC style exchanger. At a dope contact angle of 60° the gain was two (×2). Lower fin surface fouling through increased velocities was taught by U.S. Pat. No. 4,538,677 (Bodas) and Japanese 56-130598 (Jukogyo).

SUMMARY OF THE INVENTION

Experiments were run with different texturized roll patterns operating at different rolling pressures. Elongation and hardening of fin strip and dimensions of the female impressions were measured. Trade-offs were made on the nature of surface most enabling rate increases versus that negatively impacting the manufacturing process. Since most manufacturing processes critically depend on speed, any reduction in processing time was avoided.

Field tests of several projects were conducted with each project selected to demonstrate some different manufacturing capability or operating condition. Each of the projects was a boiler economizer with two identical units supplied, one with smooth solid fin, one with textured solid fin. Testing twin units simultaneously in this fashion eliminates much of the field testing uncertainty.

Film heat transfer rate is embodied in the Nusselt number and typically related by: $Nu=a(Re)^m (Pr)^n$. The object of this invention is to increase the exponent "m", such that it can predominate, knowing that the constant "a" will decrease. The exact nature of texturizing determines these values. See FIG. 27 showing that at higher Reynolds Numbers the texturized fin surface has higher transfer rates. With square or diamond shape impressions 0.020" across on 0.040" spacing, gas transfer rates are increased 10% at a Reynolds Number of 10,000 and continue to show improvement over smooth fins down to Re=4,000. This is where most applications operate so texturizing has a practical, beneficial effect. Now, several fin design parameters change with texturizing including a unit area gain. Unit heat transfer area gains are typically from five to two percent. In the above example the gain was two percent. So the transfer rate gains at higher Reynolds Numbers are not the single consequence of unit area gain.

Since most equipment design must work with a fixed amount of pressure loss, it is just as important that the texturizing add very small pressure drop penalties over smooth fin. It is not well understood that while the fin face condition and area contribute heavily to the heat transfer, the same is not true with the pressure losses. The major contributor to this loss is the fintube shape itself. The specific condition of the fin face surface and expansion/contraction losses are minor parts. In a typical finned boiler bank the fin face frictional pressure drop is approximately thirty percent of the total pressure loss. The pressure drop penalty associated with texturizing is extremely small.

BRIEF DESCRIPTION OF THE DRAWINGS

FIG. 2(*b*) is a texturized fin similar to fin 2(*a*) with a different impression shape;

FIG. 3(*b*) is a texturized fin similar to fin 3(*a*) showing a different impression shape;

FIG. 9(*b*) is a diagrammatic illustration of texturizing rolls placing their impressions on the fin as the fin is being applied to the tube;

DETAILED DESCRIPTION OF THE PREFERRED EMBODIMENTS

Figure 9A:
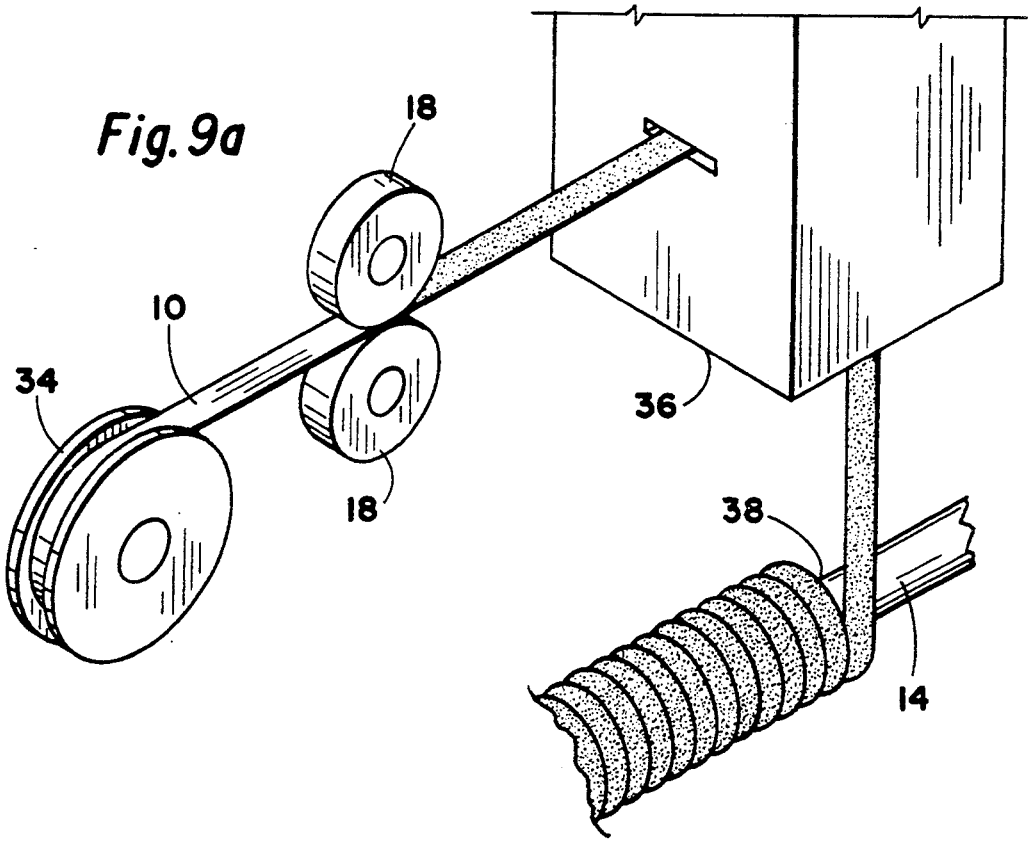
FIG. 9(*a*) is a diagrammatic illustration of texturizing rolls placing their impressions on the fin prior to the winding of the same on the tube.
Figure 9B:
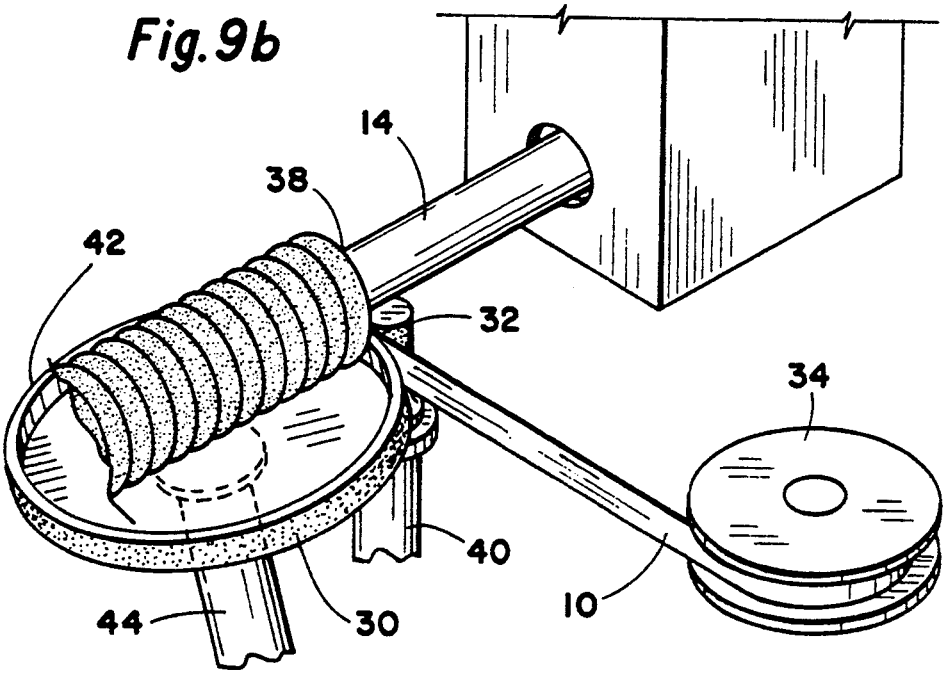
Figure 10:
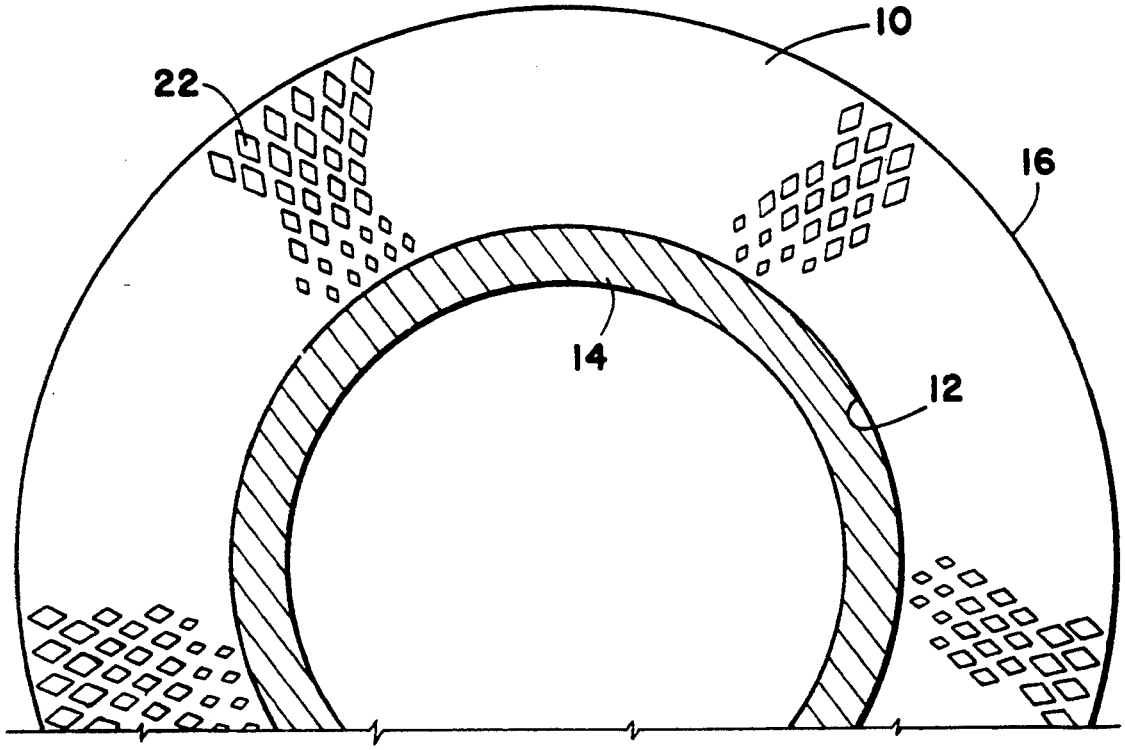
FIG. 10 is a fragmentary cross-sectional view through a finned tube wherein a preferred texturizing pattern has been applied to the fin.

Referring to the drawings in detail, FIGS. 9 and 10 show a metallic fin 10 being edge-wound on a metallic tube 14. The edge 12 wound on the tube, known as the proximal edge, is permanently attached to the tube. One preferred attachment is by high frequency welding. Another preferred attachment is by the embedding of the proximal edge into the outer tube surface. The opposite fin edge 16, known as the distal edge, is stretched and undergoes some thinning in cross-section.

Referring now to FIG. 9(*a*) the fin 10 is supplied from a supply station or roll 34 on which the strip is wound and proceeds to and through texturizing rolls 18, from the texturizing rolls through a direction-changing device 36 and to a fin attachment station or location 38 where the fin 10 is edge wound on the metallic tube.

In FIG. 9(*b*) the fin 10 is mounted on a roll or supply station 34 so that it is fed directly to the fin attachment station. One roller 32 contacts one side of the fin 10. This roller 32 is mounted at the top of a vertical spindle shaft 40. Another impression roller 30 having a beveled lip 42 is also positioned at the fin attachment station 38 so as to engage the opposite side of the fin strip from that engaged by the roller 32. In order to provide clearance between the roller 30 and the finned tube which is being formed, the roller 30 is mounted on an inclined shaft 44. However, the lip 42 has an outer surface which is parallel to the surface of the roller 32, and the lip 42 fits into the space between adjacent convolutions of the fin as it is initially wound on the tube 14.

When placed near the tube finning surface, the texturizing rolls will cause cold forming of the fin around the tube diameter. After attachment, the texturized fin faces define the fin height. The fin stands nearly perpendicular to the tube surface, and in any case deviates less than 10° from true perpendicular. With the fins uniformly and precisely spaced, the number of fins spaced per unit length may increase to increase the unit area. This feature is practically limited by thermal-hydraulic considerations, not machinery limitations. Very thin fins 0.016" thick may have as little free space between fins as 0.080". In 0.060" thick fins this free space between fins is limited to no less than 0.130". Note that in any fin thickness, the texturizing will have a beneficial effect on this limiting parameter.

Figure 1:
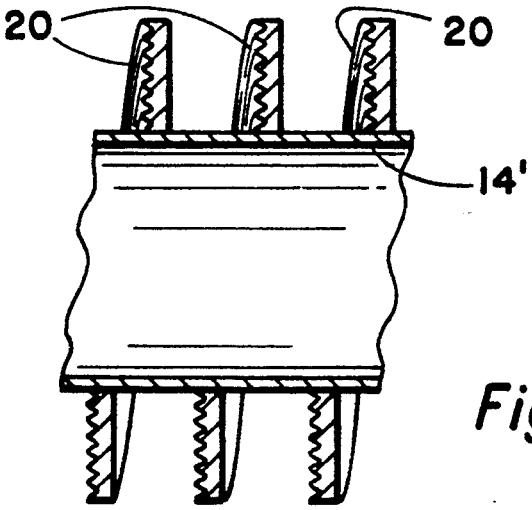
FIG. 1 is a prior art illustration showing one method of increasing the fin surface area.

FIG. 1 shows a prior art finned tube of the type disclosed in British Patent No. 906,282 to Carr. This prior art finned tube includes a fin 10' attached to a tube 14' wherein one surface of the fin is provided with grooves 20 so that, in the cross-section (as shown), the fin surface appears to have a saw-tooth shape.

Figure 2A:
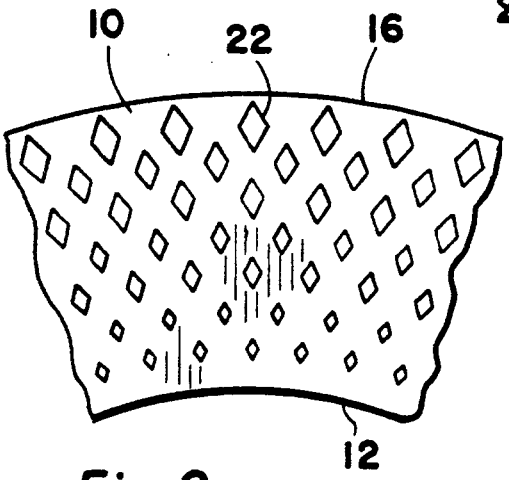
FIG. 2(*a*) is a texturized fin made in accordance with the present invention wherein female impressioning is done before the solid fin forming, illustrating texture gradient from fin tip to fin base.
Figure 2B:
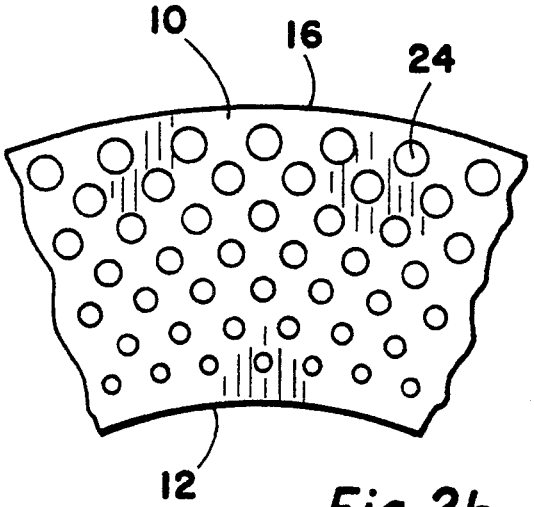

FIG. 2(*a*) represents a fin 10 which has been treated by the texturizing rolls shown in FIG. 9(*a*) prior to wrapping of the fin 10 on the tube 14. The rolls 18 necessary to produce the pattern in FIG. 2(*a*) would be provided with diamond-shaped male projections so as to produce the diamond-shaped female impressions 22 in the surface of the fin. These diamond-shaped impressions would be on both sides of the fin 10. Since the fin 10 of FIG. 2(*a*) is wound helically on tube 14 after the texturizing, the diamond-shaped impressions are smaller adjacent to the proximal edge 12 of the fin 10 and increase in size to the distal edge 16 thereby providing a texture gradient from fin tip to fin base.

FIG. 2(*b*) is similar to FIG. 2(*a*), the difference being that the impression rollers would be provided with a circular male projection which produces the circular female impression 24. Since the texturized fin of FIG. 2(*b*) is also produced by the texturizing rollers of FIG. 9(*a*), FIG. 2(*b*) illustrates a similar texture gradient from fin tip to fin base.

Figure 3A:
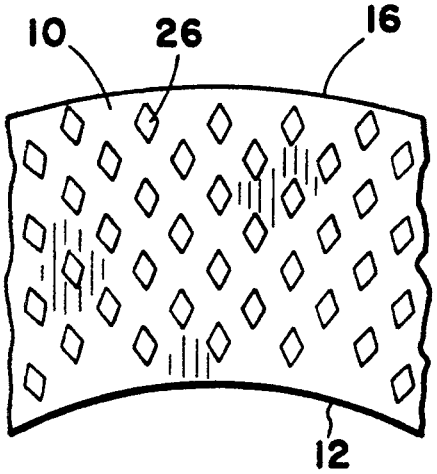
FIG. 3(*a*) is a texturized fin wherein female impressioning is done as the solid fin is forming, illustrating constant texture across the fin height.
Figure 3B:
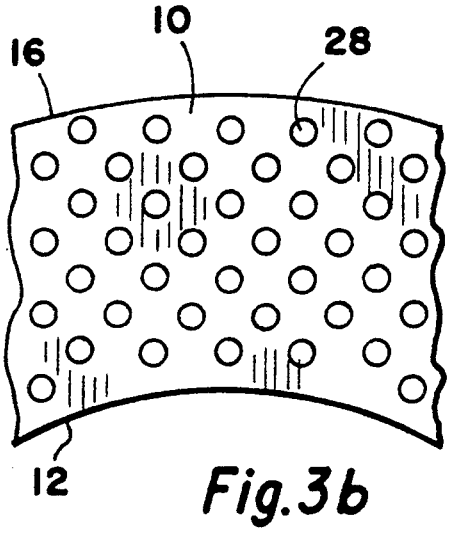

FIG. 3(*a*) represents a fin 10 which has been treated with the texturizing rollers 30 and 32 of FIG. 9(*b*). The rollers 30 and 32 would be provided with male diamond-shaped projections so as to produce the diamond-shaped impressions 26 shown on the fin 10. However, since the rollers 30 and 32 place the impression on the fin 20 as it is being bent around the tube 14, there will be no texturizing gradient between the proximal edge 12 and the distal edge 16. Therefore there is a constant texture across the fin height.

FIG. 3(*b*) is similar to FIG. 3(a), the difference being that the texturizing rollers 30 and 32 are provided with circular male projections which produce the circular female impressions 38. Again, the texturized fin of FIG. 3(*b*) is produced by the method of FIG. 9(*b*) and, therefore, there is a constant texture across the fin height.

Figure 4:
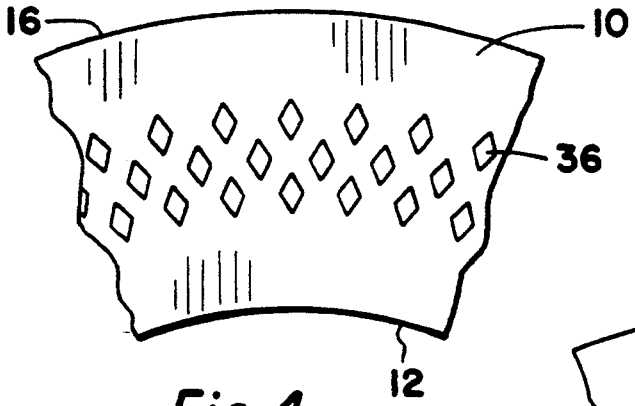
FIG. 4 is a textured fin made in accordance with the present invention wherein the middle portion only is texturized.

FIG. 4 is a texturized fin which is produced by the method of FIG. 9(*a*) where the two rollers are provided with diamond-shaped male projections which contact the central area only of the fin strip 10 to produce the female impressions 36. Note that the diamond-shaped impressions are spaced from the proximal edge 12 to the distal edge 16.

Figure 5:
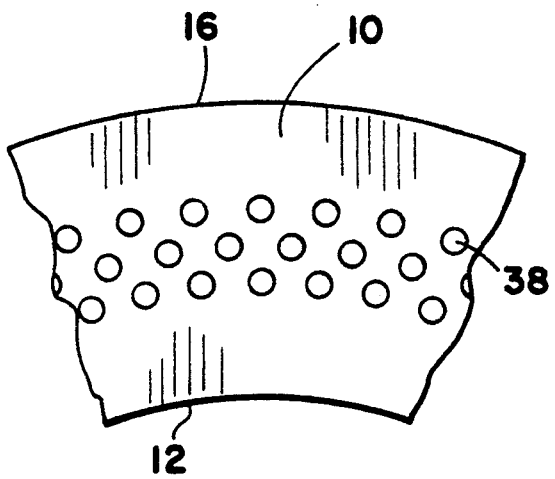
FIG. 5 is a texturized fin similar to FIG. 4 but showing a different impression shape.

FIG. 5 shows a texturized fin similar to that of FIG. 4 where the impression rollers 30 and 32 are provided with circular male projections providing the circular female impressions 38 on the fin. As in the case of FIG. 4, these impressions 38 occur in the central area only of the fin strip and they are on both sides of the fin 10.

Figure 6:
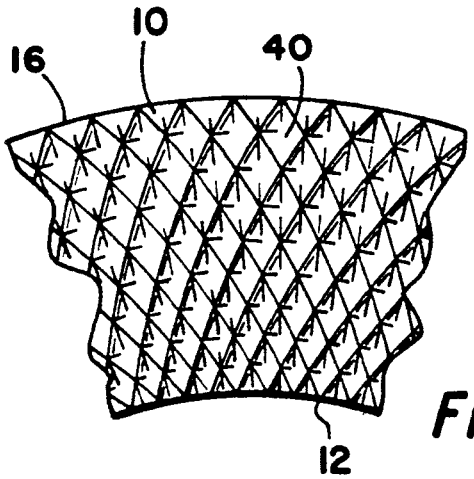
FIG. 6 is a texturized fin where the impressions touch one another.

FIG. 6 shows a fin strip 10 which is produced by the method shown in FIG. 9(*a*) where the rollers 18 are provided with a plurality of diamond-shaped male projections which are contiguous to each other, thereby producing the diamond-shaped female impressions 40 which are also contiguous to each other. FIG. 6 shows the sizes of the impressions 40 increase outwardly from the proximal edge 12 to the distal edge 16 of the fin strip 10.

Figure 8:
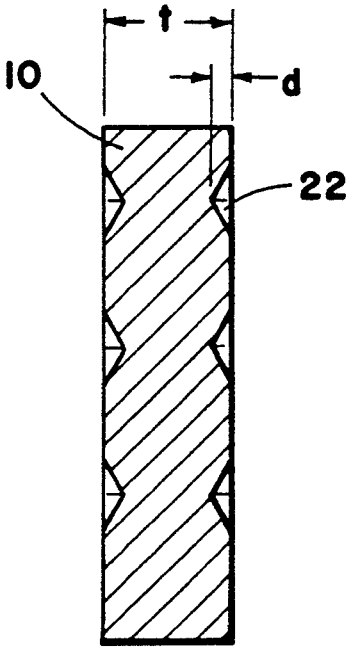
FIG. 8 is a cross-sectional view taken along section line 8—8 of FIG. 7 showing the depth of the preferred texturizing pattern.
Figure 7:
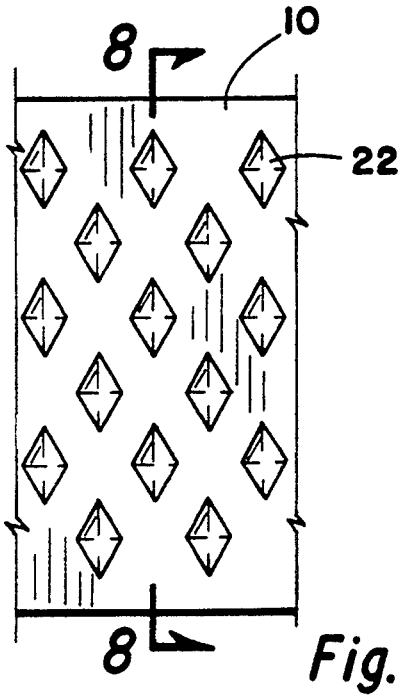
FIG. 7 is a detail of a preferred texturizing pattern.

FIG. 7 is a fragmentary view of a portion of a fin strip, such as FIG. 3(*a*), showing an enlarged arrangement of the female impressions 22. As shown in the cross-sectional view of FIG. 8, the female impressions can be as deep as 0.006".

FIG. 10 is a cross-sectional view through the tube 14 showing one helical winding of the fin 10 wherein the patterns or impressions 22 are essentially the same as those shown in FIG. 2(*a*). The sizes of the impressions 22 increase outwardly from the proximal edge 12 to the distal edge 16 of the fin strip 10.

Figure 11:
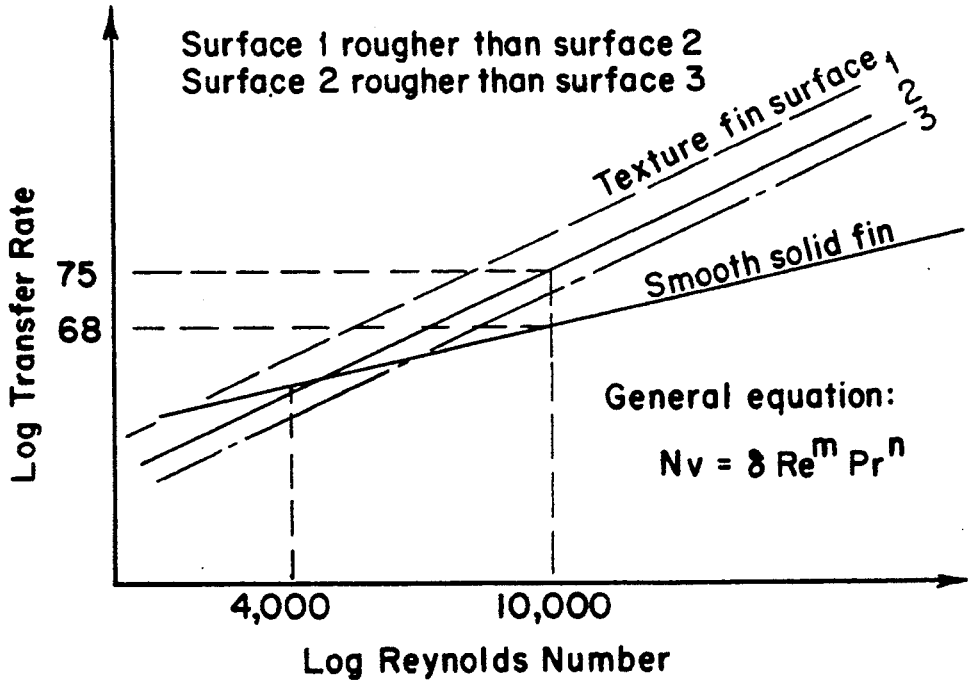
FIG. 11 is a graph which plots the log of the transfer rate against the log of the Reynolds Number.

FIG. 11 shows a graph which plots the log of the transfer rate against the log of the Reynolds number. This graph includes a plot for a smooth solid fin and three textured fins. Plot 3 represents the least textured surface. Plot 2 represents a surface which is more textured than Plot 3. Plot 1 represents a surface which is more textured (rougher) than surface 2. Thus, in Reynolds numbers in excess of 4,000 all of the textured surfaces exhibit a higher transfer rate than a smooth solid fin. Surface 2 shows a higher transfer rate than surface 3, and surface 1 shows a higher transfer rate than surface 2.

The two hardened steel rolls 18 are faced with the male impressions pattern. In one preferred embodiment, both rolls are faced with a diamond shaped form on a rectangular 0.040" spacing. In another preferred embodiment, both rolls are faced with a right cone on a rectangular 0.020" spacing. Since the roll material is much harder than the fin material, the desired texturing proceeds with a minimum of undesirable fin material changes. Both rolls are the same diameter when supplying only texturizing elongation, and of course one is much smaller when supplying curvature and elongation. Roll width at least matches fin height and the roll diameter is approximately 5". FIGS. 9(*a*) and 9(*b*) illustrate different roll positioning.

At the texturing rolls, the fin has its ultimate height undergo negligible dimensions change. Rolling pressures are adjusted to produce the exact nature of texture desired. To aid in this selection, a sample fin is measured for elongation and examined under magnification. A preferred embodiment is a square impression producing 6.5% elongation in 0.050" thick fin material and 3.5% in 0.075" thick fin material. As examined under magnification, the depth of texturizing is shallow. If the texturizing form completely covers the fin face, leaving no remaining smooth surface, then unit surface area increase will approach 12%. But in any form, texturizing is characterized by very small, variable spaced features.

This improvement to the finning product does not slow down firming machinery. The textured product may be combined in bundles, bent into coils, or arranged by any present fabrication technique. All the solid fin handling, shipping and durability advantages are preserved.

What is claimed is:

1. A finned tube comprising a tube and a texturized solid fin attached thereto, the fin having a proximal edge and an opposite distal edge, the proximal edge being attached helically to the tube so the fin extends outwardly from the tube, the fin having two opposite faces extending from the proximal edge to the distal edge, the two faces of the fin being texturized by regular, small female impressions, wherein the is applied to the tube at a fin attachment station and wherein the fin is directed to the fin attachment station from a fin material supply station, wherein the texturizing rollers are provided with male projections which contact the faces of the fin only in a middle area centered between in the proximal edge and the distal edge and occupying no more than approximately 50% of the area lying between said edges.

2. A finned tube comprising a tube and a texturized solid fin attached thereto, the fin having a proximal edge and an opposite distal edge, the proximal edge being attached helically to the tube so the fin extends outwardly from the tube, the fin having two opposite faces extending from the proximal edge to the distal edge, the two faces of the fin being texturized by regular, small female impressions, wherein the fin is applied to the tube at a fin attachment station and wherein the fin is directed to the fin attachment station from a fin material supply station, wherein the impressions are provided in the faces of the fin by a pair of texturizing rollers having faces containing male projections corresponding to female impressions, the texturizing rollers contact the fin at the fin attachment station, wherein the texturizing rollers are provided with male projections which contact the faces of the fin only in a middle area centered between the proximal edge and the distal edge and occupying no more than approximately 50% of the area lying between said edges.

* * * * *